US011737563B2

(12) United States Patent
Kay

(10) Patent No.: US 11,737,563 B2
(45) Date of Patent: Aug. 29, 2023

(54) FOLDABLE SEAT

(71) Applicant: Charles Kay, Hampstead (CA)

(72) Inventor: Charles Kay, Hampstead (CA)

( * ) Notice: Subject to any disclaimer, the term of this patent is extended or adjusted under 35 U.S.C. 154(b) by 0 days.

(21) Appl. No.: 17/170,017

(22) Filed: Feb. 8, 2021

(65) Prior Publication Data

US 2021/0244189 A1 Aug. 12, 2021

Related U.S. Application Data

(60) Provisional application No. 62/971,067, filed on Feb. 6, 2020.

(51) Int. Cl.

| | |
|---|---|
| ***A47C 4/02*** | (2006.01) |
| ***A47C 4/04*** | (2006.01) |
| ***A47C 4/28*** | (2006.01) |

(52) U.S. Cl.

CPC ..... *A47C 4/02* (2013.01); *A47C 4/045* (2013.01); *A47C 4/283* (2013.01)

(58) Field of Classification Search

CPC ..... A47C 4/02; A47C 4/045; A47C 4/283; A47C 4/028

USPC ..... 297/42, 440.11, 59

See application file for complete search history.

(56) References Cited

U.S. PATENT DOCUMENTS

| | | | | | |
|---|---|---|---|---|---|
| 1,652,942 | A * | 12/1927 | James | A47B 3/12 | 248/167 |
| 2,137,312 | A * | 11/1938 | Thompson | A47C 1/16 | 297/440.11 |
| 2,717,634 | A * | 9/1955 | Lisi | A47C 4/028 | 297/440.16 |
| 3,201,172 | A * | 8/1965 | Bliss | A47C 3/12 | 297/448.1 |
| 8,789,477 | B2 * | 7/2014 | Jimenez Mangas | A47B 13/02 | 108/115 |
| D856,725 | S * | 8/2019 | Maughan | D6/708 | |
| 10,368,635 | B2 * | 8/2019 | Reinhart | A47B 9/00 | |
| 2008/0143166 | A1 * | 6/2008 | de Oliveira | A47C 9/007 | 297/440.14 |
| 2008/0169389 | A1 * | 7/2008 | Hill | F16M 11/22 | 248/166 |

* cited by examiner

*Primary Examiner* — Milton Nelson, Jr.
(74) *Attorney, Agent, or Firm* — PRAXIS

(57) ABSTRACT

A foldable seat comprises a vertically extending support arrangement, a seat member and a pivot assembly. The vertically extending support arrangement has a vertical axis and a horizontal plane and comprises opposite top and bottom ends along the vertical axis, and a geometric outer perimeter in the horizontal plane having a perimeter size. The seat member is mounted to the top end of the vertically extending support arrangement. The pivot assembly is mounted to the vertically extending support arrangement for pivoting about a pivot axis parallel to the vertical axis. Pivoting the pivot assembly provides for moving the vertically extending support arrangement between folded and unfolded positions respectively decreasing and increasing the perimeter size.

1 Claim, 4 Drawing Sheets

FOLDABLE SEAT

CROSS-REFERENCE TO RELATED APPLICATIONS

The present application claims priority on U.S. Provisional Patent Application No. 62/971,067, filed on Feb. 6, 2020 and incorporated herein by reference in its entirety.

TECHNICAL FIELD

The present disclosure generally relates to seats such as chairs and stools. More particularly but not exclusively, the present disclosure relates to a foldable seat.

BACKGROUND

Foldable seats are well known in the art and they are generally seating furniture that is folded away so as to occupy less space. A typical foldable seat is a folding chair which is a light, portable chair that folds flat or to a smaller size, and can be stored in a stack, in a row, or on a cart. Most folding chairs pivot at the seat level. The seat aligns between the back supports. The back support and the front legs are the same part. Alternative included chairs that that fold under the seat.

Objects

An object of the present disclosure is to provide a foldable seat.

An object of the present disclosure is to provide a seat such as a chair or a stool and the like that is foldable about the vertical axis.

SUMMARY

In accordance with an aspect of the present disclosure, there is provided a foldable seat comprising: a vertically extending support arrangement for being mounted to a surface and having a vertical axis and a horizontal plane, the vertically extending support arrangement comprising opposite top and bottom ends along the vertical axis, and a geometric outer perimeter in the horizontal plane having a perimeter size; a seat member being mounted to the top end of the vertically extending support arrangement; and a pivot assembly mounted to the vertically extending support arrangement for pivoting about a pivot axis parallel to the vertical axis, wherein pivoting the pivot assembly provides for moving the vertically extending support arrangement between folded and unfolded positions respectively decreasing and increasing the perimeter size.

In an embodiment, the foldable seat further comprises a back structure vertically extending from the top end of the vertically extending support arrangement. In an embodiment, the back structure comprises a removable top horizontal backrest member mountable to vertical back posts.

In an embodiment, the vertically extending support arrangement comprises a plurality of spaced apart legs positioned about the pivot axis. In an embodiment, the pivot assembly comprises connectors for connecting diagonally disposed legs, the connectors being connected together at the pivot axis by a pivot. In an embodiment, when the vertically extending support structure is moved to the folded position adjacent pairs of legs are positioned relatively closer together. In an embodiment, the plurality of legs comprises four spaced apart legs defining opposite front and rear sides and opposite lateral sides of the vertically extending support arrangement. In an embodiment, when the vertically extending support structure is moved to the folded position adjacent pairs of legs at the front side are provided to be positioned relatively closer together and adjacent pairs of legs at the rear side are provided to be positioned relatively closed together. In an embodiment, when the vertically extending support structure is moved to the folded position adjacent pairs of legs at the first lateral side are provided to be positioned relatively closer together and adjacent pairs of legs at the second lateral side are provided to be positioned relatively closed together.

In an embodiment, the pivot assembly is positioned at the top end of vertically extending support arrangement. In an embodiment, the seat member is positioned on top of the pivot assembly.

In an embodiment, the seat member is removably mounted to the vertically extending support arrangement, wherein when the seat member is mounted to the vertically extending support arrangement it blocks the pivot assembly from pivoting.

The foldable seat of the disclosure is provided to be folded along a vertical axis thus providing for a plurality of similar foldable seats to be positioned when not in use or during transport in an upstanding fashion leaning against one another. The foregoing facilitates arranging these seats in an area, removing them therefrom and transporting them as the structure is flattened without laterally protruding seat member parts as in typical foldable chairs. The disclosed structure is convenient for chairs and bar style stools.

Other objects, advantages and features of the present disclosure will become more apparent upon reading of the following non-restrictive description of illustrative embodiments thereof, given by way of example only with reference to the accompanying drawings.

DETAILED DESCRIPTION OF ILLUSTRATIVE EMBODIMENTS

Generally stated and in accordance with an aspect of the present disclosure, there is provided a foldable seat such as a chair or a stool. The seat comprises a vertically extending support arrangement for being mounted to a surface in order to upstand therefrom. The vertically extending support arrangement has a vertical axis and a horizontal plane. The vertically extending support arrangement comprises opposite top and bottom ends along the vertical axis, and a geometric outer perimeter in the horizontal plane having a perimeter size. A seat member is mounted to the top end of the vertically extending support arrangement. A pivot assembly is mounted to the vertically extending support arrangement for pivoting about a pivot axis. The pivot axis is parallel to the vertical axis. Pivoting the pivot assembly provides for moving the vertically extending support arrangement between folded and unfolded positions in order to respectively decrease and increase the perimeter size.

With respect to the Figures, non-restrictive illustrative embodiments of the disclosure will be described to further exemplify the disclosure and by no means limit the scope thereof.

Figure 1:
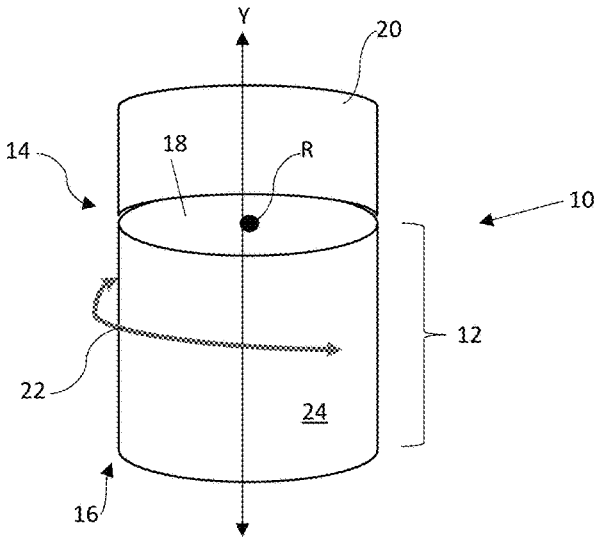
FIG. 1 is a schematic representation of a foldable seat having a cylindrical configuration in accordance with a non-restrictive illustrative embodiment of the present disclosure.
Figure 2:
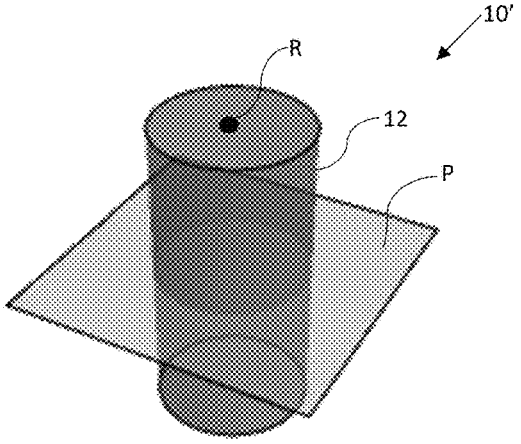
FIG. 2 is a schematic representation of a foldable seat having a cylindrical configuration without a backrest in accordance with a non-restrictive illustrative embodiment of the present disclosure.
Figure 3:
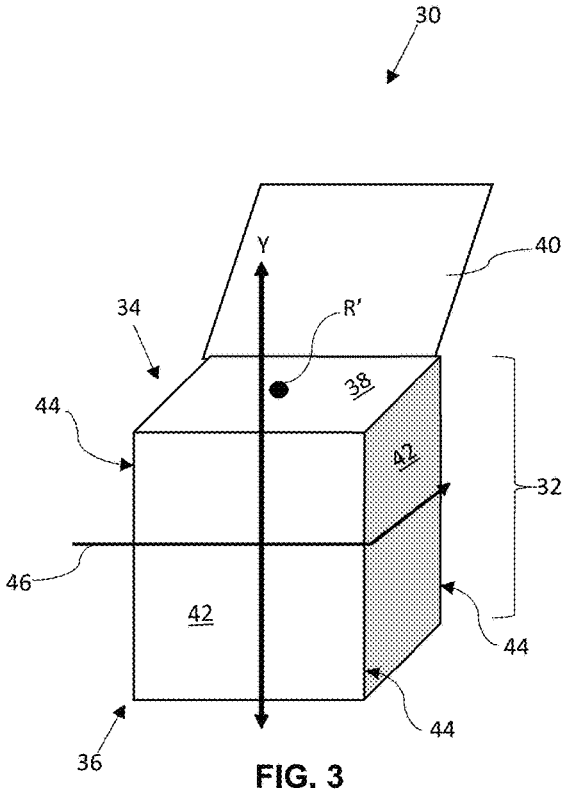
FIG. 3 is a schematic representation of a foldable seat having a cubical configuration in accordance with a non-restrictive illustrative embodiment of the present disclosure.

Referring to FIGS. 1-3, schematic versions of the foldable seat will be described to provide a general overview of the general geometric configuration thereof and to exemplify that a variety of geometric shapes can be contemplated by the skilled artisan within the scope of the present disclosure. Particularly, FIGS. 1-3 will assist in describing the following terms of art: a vertical axis, a horizontal plane, a geometric outer perimeter along the horizontal plane and the perimeter size. It is further understood herein and as will be further exemplified in FIGS. 4-8, that a geometric outer perimeter along the horizontal plane is provided by a contiguous surface (FIGS. 1-3) or by discontinuous separate elements (e.g. legs in FIGS. 4-6 and 8) that when seen as a whole define the perimeter of a common arrangement they belong to (e.g. vertical support structure).

FIG. 1 shows a foldable seat 10 comprising a vertically extending support structure arrangement 12 defining top and bottom ends thereof, 14 and 16 respectively with a seat member 18 mounted to the top end 14. The support structure arrangement 12 has a generally cylindrical shape. A back structure 20 extends upwardly from the support structure arrangement 12. Alternatively, and as shown in FIG. 2, the seat 10' is provided without a back structure 20. The vertically extending support structure arrangement 12 has a vertical axis Y shown in FIG. 1. The ends 14 and 16 of the support structure arrangement 12 are positioned along the vertical axis Y. The support structure arrangement 12 also has a horizontal plane P shown in FIG. 2. The support structure arrangement 12 defines a geometric outer perimeter 22 along the plane P having a perimeter size. In this example, the perimeter 22 runs along the cylindrical surface 24.

The seat 10 includes a pivot (see pivot point R) about an axis that is parallel with the vertical axis Y which provides for moving the support structure to a folded position about the Y axis to decrease the size of the perimeter 22. The size of the perimeter 22 is increased when unfolding the support structure arrangement 12 about the pivot axis Y.

In an embodiment, the support structure arrangement 12 comprises an external skirt overlaying an internal cross or X structure stand defining a central pivot assembly (where the pivot axis runs thought point R) for moving the cross or structure stand to a closed position. The cross or X structure comprises externally curved wall parts for providing the skirt with a curvature as it extends from wall part to wall part about the vertical axis Y thereby defining the cylindrical surface 24.

Turning to FIG. 3, there is shown a foldable seat 30 comprising a vertically extending support structure arrangement 32 defining top and bottom ends thereof, 34 and 36 respectively with a seat member 38 mounted to the top end 34. A back structure 40 extends upwardly and outwardly from the support structure arrangement 32. Similarly, to foldable seats 10 and 10', the support structure arrangement 32 has a vertical axis Y and a horizontal plane P and is provided with a pivot axis running through point R' in a parallel relationship with the vertical axis Y.

The support structure arrangement 32 comprises a cubical configuration comprising side panels 42 connected together at fold corners 44 and defining a perimeter 46 along the horizontal plane P. A cross or X stand structure holds the panels in place and comprises a central pivot assembly that provides for closing the cross or X stand structure thereby collapsing and folding the panels 42 about their fold corners to decrease the size of the perimeter.

Figure 4:
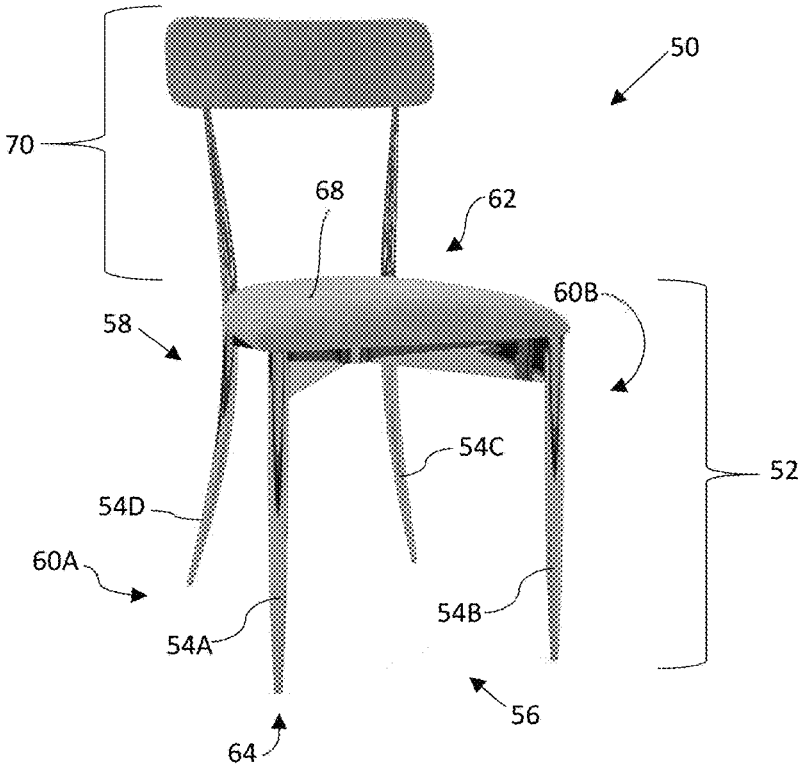
FIG. 4 is a perspective view of the foldable seat in the form of a foldable chair in accordance with a non-restrictive illustrative embodiment of the present disclosure.

FIG. 4 shows a foldable seat 50 in the form of a chair.

The foldable chair 50 comprises a vertically extending support arrangement or vertical support structure 52 in the form of four legs 54A, 54B, 54C and 54D. The legs 54A, 54B, 54C and 54D define a general cubical configuration with each leg providing a respective corner and the spaces between and aligned with adjacent leg pairs (54A and 54B, 54B and 54C, 54C and 54D, 54D and 54A) provide faces or sides. Thus, the vertical support structure 52 defines a front side 56, a rear side 58, opposite lateral sides 60A and 60B. The foregoing cubical configuration of the vertical support structure 52 defines a perimeter along the horizontal plane P of the cubically configured vertical support structure 52 running along each side 56, 58, 60A and 60B. The vertical support structure 52 also has vertical axis Y defining a top end 62 and a bottom end 64. A seat member 68 is mounted to the top end 62 and a back structure 70 extends therefrom at the rear side 58.

FIGS. 5-8 show a foldable seat 100 in the form of a stool. Chair 50 and stool 100 are similarly constructed with the exception that the height of the legs of stool 100 is greater than the height of the legs of chair 50. The additional elements described for foldable seat 100 are thus applicable to chair 50 mutatis mutandis.

The foldable stool 100 comprises a vertically extending support arrangement or vertical support structure 102 in the form of four legs 104A, 104B, 104C and 104D.

The legs 104A, 104B, 104C and 104D define a general cubical configuration with each leg providing a respective corner and the spaces between and aligned with adjacent leg pairs (104A and 104B, 104B and 104C, 104C and 104D, 104D and 104A) provide faces or sides. Thus, the vertical support structure 102 defines a front side 106, a rear side 108, opposite lateral faces 110A and 110B. The foregoing cubical configuration of the vertical support structure 102 defines a perimeter 112 along the horizontal plane P of the cubically configured vertical support structure 102 running along each side 106, 108, 110A and 110B. The vertical support structure 102 has vertical axis Y defining a top end 114 and a bottom end 116. A seat member 118 is mounted to the top end 114 and a back structure 120 extends therefrom at the rear side 108.

Figure 6:
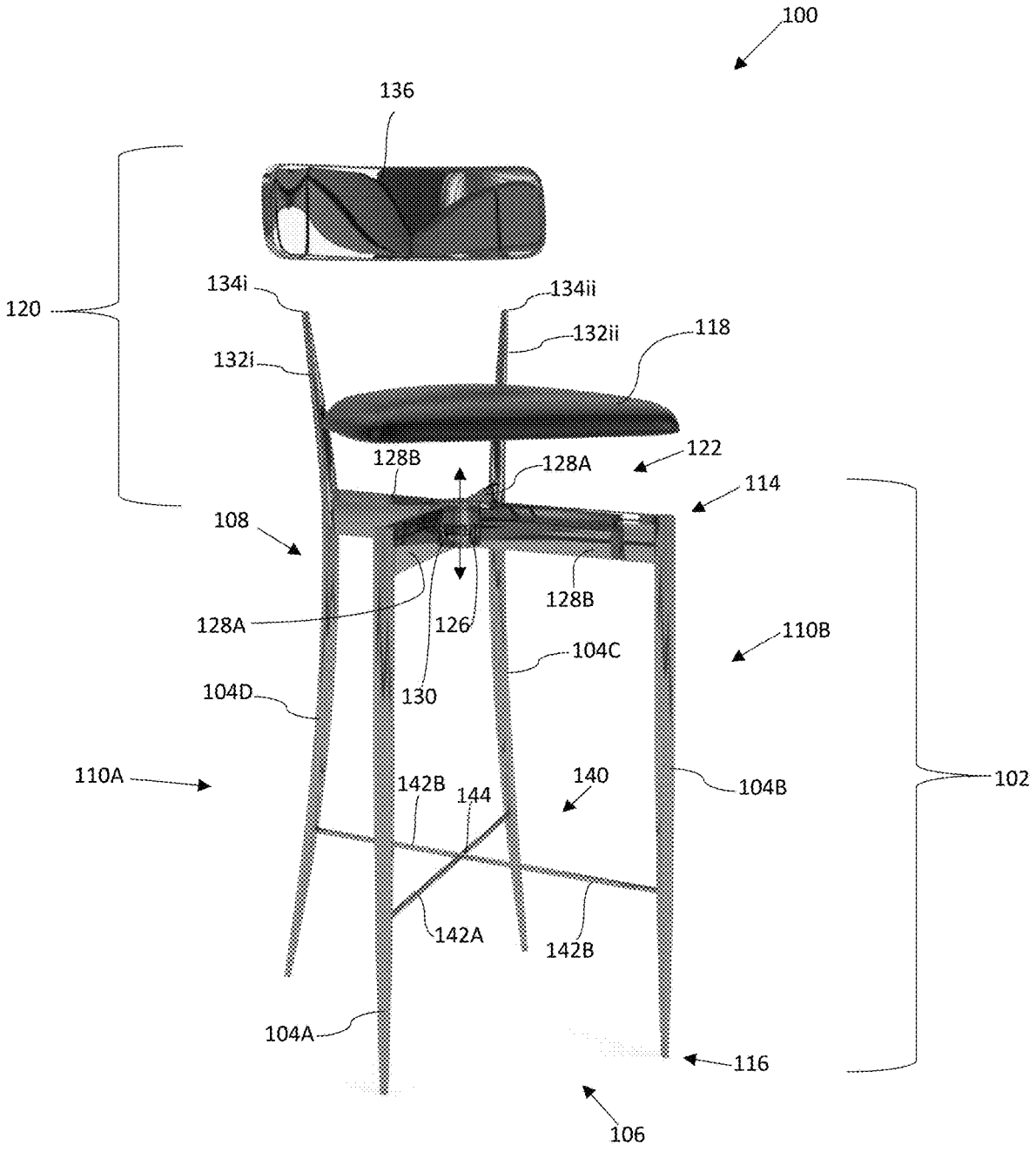
FIG. 6 is a is a perspective view of the foldable seat of FIG. 5 in a disassembled position in accordance with a non-restrictive illustrative embodiment of the present disclosure.
Figure 7:
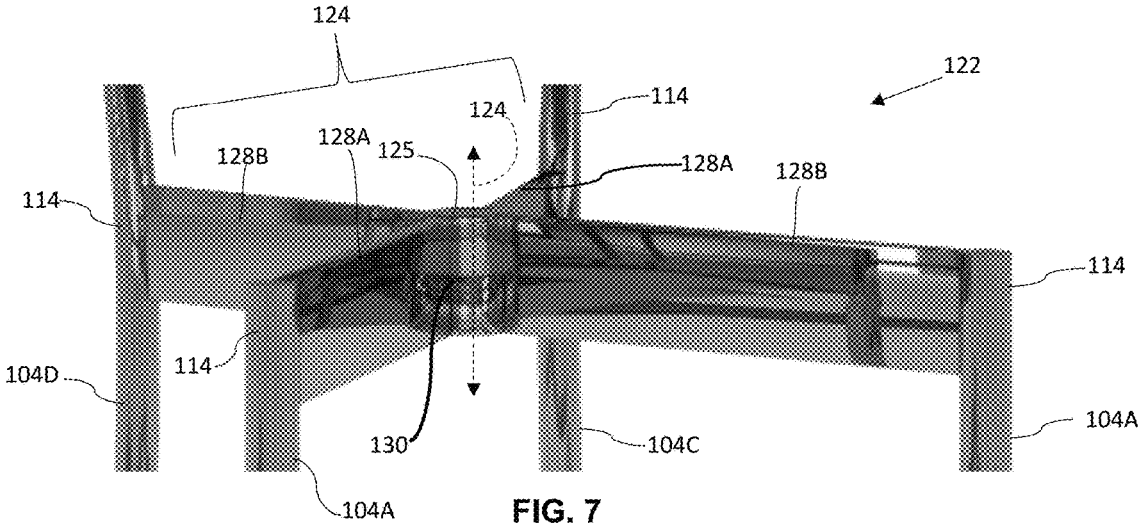
FIG. 7 is a perspective close-up view of the pivot assembly of the foldable seat of FIG. 5 in accordance with a non-restrictive illustrative embodiment of the present disclosure.
Figure 8:
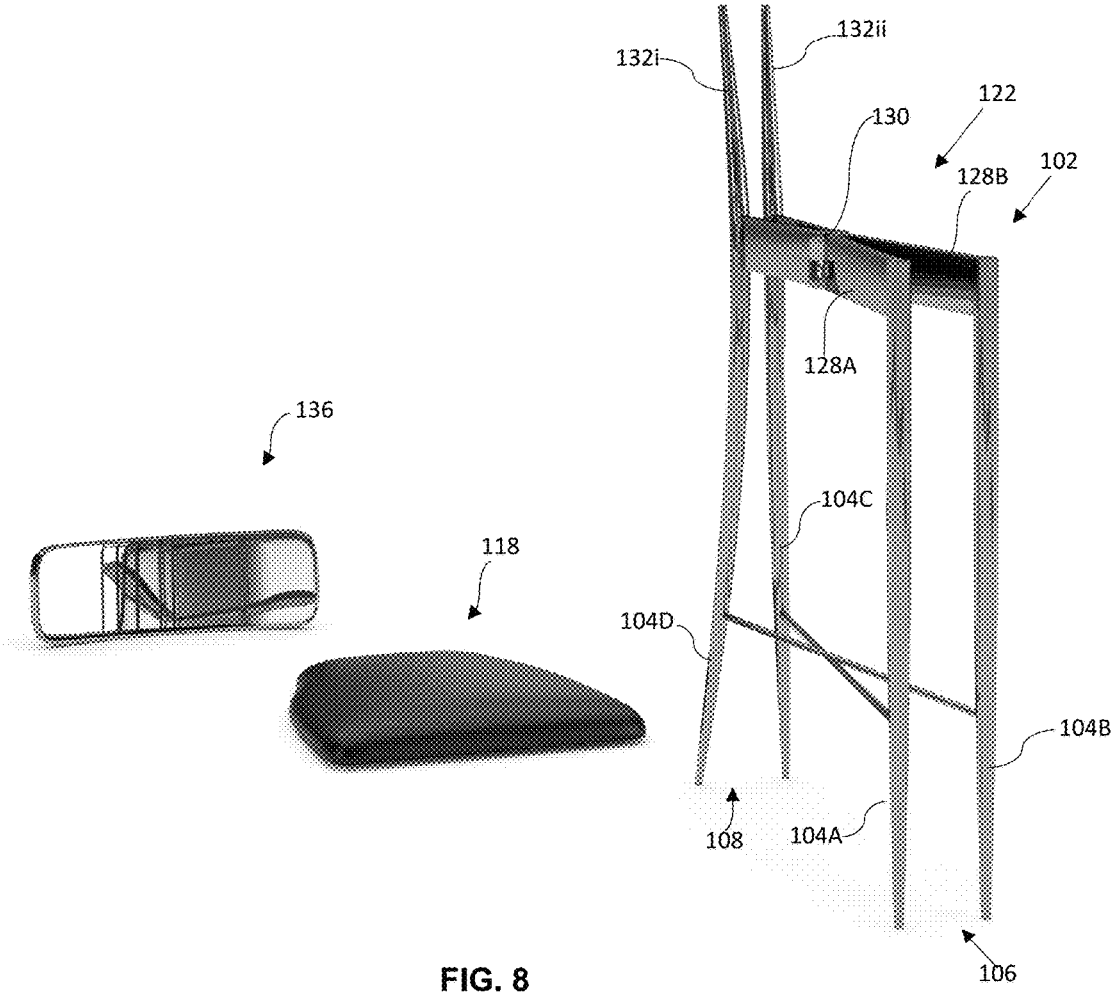
FIG. 8 is a is a perspective view of the foldable seat of FIG. 5 in an assembled and folded position in in accordance with a non-restrictive illustrative embodiment of the present disclosure.

The seat member 118 is removable from the top end 114 as shown in FIG. 6.

A pivot assembly 122 is mounted to the vertical support structure 102. In this non-limiting example, the pivot assembly 122 is positioned at the top end 114 of structure 102. The pivot assembly 122 comprises a cross or X structure 124 with a central pivot 125 at the common connection point defining a pivot axis 126 that is parallel to the vertical axis Y, thereby providing the legs to be brought closer (folded position) or further apart (unfolded position) when the vertical support structure 102 is moved about the pivot axis 126.

The cross structure 124 comprises a pair of connectors 128A and 128B connecting diagonally disposed legs at the top ends 114 thereof. In this non limiting example, connector 128A connects the top ends 114 of diagonally disposed legs 104A and 104C, whereas connector 128B connect the top ends 114 of diagonally disposed legs 104B and 104D. The connectors 128A and 128B meet at central connection provided by a cylindrical hinge pivot 130 defining the central pivot 125 and pivot axis 126.

The seat member 118 comprises undersurface connectors for engaging the connector 128A and 128B when mounted thereto.

The back structure 120 comprises vertical posts 132*i* and 132*ii* respectively upwardly (and in this example contiguously) extending from the top ends of 114 of the legs 104D and 104C. The posts 132*i* and 132*ii* provide respective top end connecting tips 134*i* and 134*ii* for removably receiving a back rest 136.

When folding the seat 100, the back rest 136 and the seat member 118 are removed and the user simply closes the cross structure 124 about the pivot axis 126 thereby bringing adjacent pairs of legs 104A and 104B closer together and concurrently brining adjacent pairs of legs 104D and 104C closer together. In this way, the front and rear sides, 106 and 108 are partially, substantially or fully closed which reduces the size of the perimeter 112 thus providing for pivotally moving the stool 100 in the folded position shown in FIG. 8. Alternatively, or optionally, the cylindrical hinge pivot 130 provides for bringing adjacent pairs of legs 104A and 104D closer together and concurrently brining adjacent pairs of legs 104B and 104C closer together. In this way, the opposite lateral sides, 110A and 110B are partially, substantially or fully closed which reduces the size of the perimeter 112.

The stool 100 also includes a stabilizer 140 formed by connectors 142A and 142B connecting diagonally disposed legs together along their length and in this example relatively closer to the bottom ends 116 of the legs which are mounted to a surface. Connector 142A connects diagonally disposed legs 104A and 104C together, whereas connector 142B connects diagonally disposed legs 104B and 104D together. The connectors 142A and 142B meet at central connection provided by a rivet and nut connection defining a pivot 144 that pivots about the pivot axis 126 when opening and closing the vertical support structure 102 as described herein.

Figure 5:
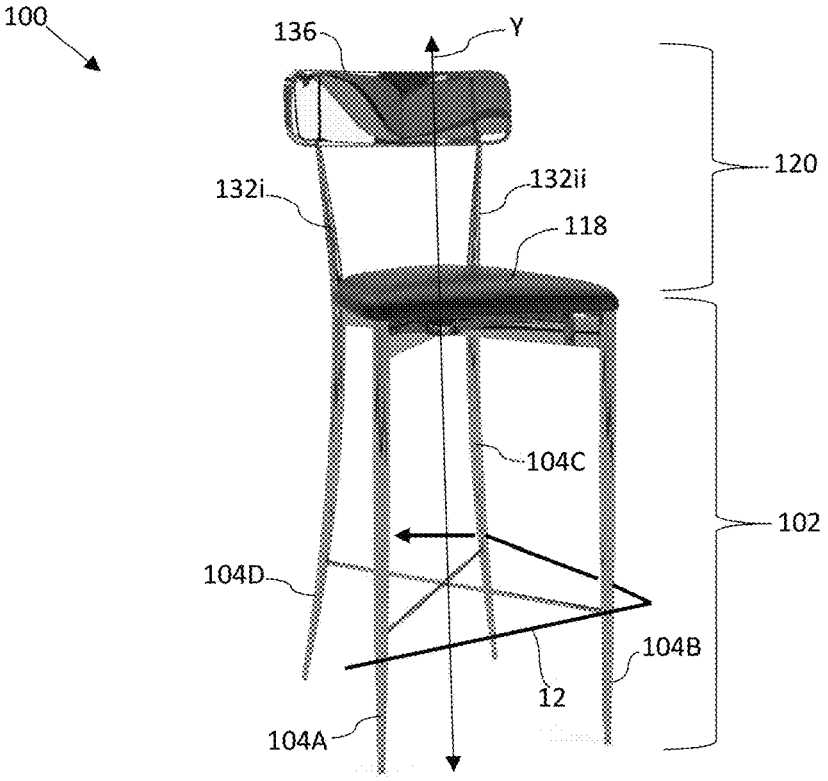
FIG. 5 is a perspective view of the foldable seat in the form of a foldable stool in accordance with a non-restrictive illustrative embodiment of the present disclosure.

The seat member 118 when mounted on the pivot assembly 122 provides for preventing pivoting and thus maintains the stool 100 in the unfolded position of FIGS. 5 and 6. The back rest 136 when mounted to the posts 132*i* and 132*ii* further provides for maintain the stool 100 in a stable unfolded position.

The seats of the disclosure are therefore stable and secure when in use.

The various features described herein can be combined in a variety of ways within the context of the present disclosure so as to provide still other embodiments. As such, the embodiments are not mutually exclusive. Moreover, the embodiments discussed herein need not include all of the features and elements illustrated and/or described and thus partial combinations of features can also be contemplated. Furthermore, embodiments with less features than those described can also be contemplated. It is to be understood that the present disclosure is not limited in its application to the details of construction and parts illustrated in the accompanying drawings and described hereinabove. The disclosure is capable of other embodiments and of being practiced in various ways. It is also to be understood that the phraseology or terminology used herein is for the purpose of description and not limitation. Hence, although the present disclosure has been provided hereinabove by way of non-restrictive illustrative embodiments thereof, it can be modified, without departing from the scope, spirit and nature thereof and of the appended claims.

What is claimed is:

1. A foldable seat comprising:

a vertically extending support arrangement for being mounted to a surface and having a vertical axis and a horizontal plane, the vertically extending support arrangement comprising opposite top and bottom ends along the vertical axis, and a geometric outer perimeter in the horizontal plane having a perimeter size and defining opposite front and rear sides and opposite lateral sides;

a seat member being removably mounted to the top end of the vertically extending support arrangement to overly the top end of the vertically extending support arrangement;

a pivot assembly mounted to the vertically extending support arrangement at the top end thereof for pivoting about a pivot axis parallel to the vertical axis;

the vertically extending support arrangement comprises four spaced apart legs positioned about the pivot axis, the four spaced apart legs comprising one pair of adjacent legs thereof positioned at the front side and another pair of adjacent legs thereof positioned at the rear side;

a back structure vertically extending from the top end of the vertically extending support arrangement, the back structure comprising a pair of spaced apart vertical back posts defining respective top free ends thereof, each of the pair of vertical back posts being contiguous with a respective one of the pair of adjacent legs thereof positioned at the rear side, the back structure comprises a removable top horizontal backrest member mountable to the top free ends of the vertical back posts, wherein pivoting the pivot assembly provides for moving the vertically extending support arrangement between folded and unfolded positions respectively decreasing and increasing the perimeter size;

wherein when the vertically extending support arrangement is moved to the folded position, the pair of adjacent legs at the front side are moved closer together, the pair of adjacent legs at the rear side are moved closer together, and the pair of spaced apart vertical back posts are moved closer together;

the pivot assembly comprising:

a cylindrical hinge body having a vertical length between top and bottom ends thereof and defining the pivot axis; and four connectors, each of the four connectors having one end thereof being integral to a respective one of the legs and an opposite end thereof being integral to the cylindrical hinge body along the full vertical length of the cylindrical hinge body, each one of the four connectors being diagonally opposed to another one of the four connectors and being integral with the cylindrical hinge body therebetween thereby blocking any relative pivoting movement between the diagonally opposed connectors about the pivot axis, each of the four connectors defining a longitudinal top end thereof extending between the respective one of the legs and the cylindrical hinge body and being substantially flush with the top end of the cylindrical hinge body, the top ends of the four connectors and the top end of the cylindrical hinge body providing for receiving the seat member when the vertically extending support arrangement is in the unfolded position, the cylindrical hinge body being configured to provide a respective space between the pair of adjacent legs at the front side, between the pair of adjacent legs at the rear side, and between the pair of spaced apart vertical back posts when the vertically extending support arrangement is in the folded position;

wherein when the seat member is mounted to the vertically extending support arrangement and/or when the backrest member is mounted to the vertical back posts, the pivot assembly is blocked from pivoting.

* * * * *